US009609995B2

(12) United States Patent
Marone

(10) Patent No.: US 9,609,995 B2
(45) Date of Patent: Apr. 4, 2017

(54) ELECTRICALLY-CONTROLLED ACTUATOR DEVICE, AND WASHING AGENTS DISPENSING DEVICE COMPRISING SUCH AN ACTUATOR DEVICE

(71) Applicant: BITRON POLAND SP. ZO.O, Sosnowiec (PL)

(72) Inventor: Giuseppe Marone, Nichelino (IT)

(73) Assignee: BITRON POLAND SP. ZO.O, Sosnowiec (PL)

( * ) Notice: Subject to any disclaimer, the term of this patent is extended or adjusted under 35 U.S.C. 154(b) by 357 days.

(21) Appl. No.: 14/369,260

(22) PCT Filed: Dec. 28, 2012

(86) PCT No.: PCT/EP2012/077061
§ 371 (c)(1),
(2) Date: Jun. 27, 2014

(87) PCT Pub. No.: WO2013/098394
PCT Pub. Date: Jul. 4, 2013

(65) Prior Publication Data

US 2014/0312061 A1 Oct. 23, 2014

(30) Foreign Application Priority Data

Dec. 30, 2011 (PL) ..... 397652

(51) Int. Cl.
*H01H 61/06* (2006.01)
*A47L 15/00* (2006.01)
(Continued)

(52) U.S. Cl.
CPC ..... *A47L 15/0021* (2013.01); *A47L 15/4409* (2013.01); *A47L 15/4463* (2013.01);
(Continued)

(58) Field of Classification Search
CPC ..... A47L 15/0021; A47L 15/4409; A47L 15/4463; H01H 21/86; H01H 37/323;
(Continued)

(56) References Cited

U.S. PATENT DOCUMENTS 4,524,343 A 6/1985 Morgan et al.
5,058,946 A 10/1991 Faber
(Continued)

FOREIGN PATENT DOCUMENTS

DE 37 31 146 A1 3/1989
DE 19 545 773 A1 6/1996
(Continued)

*Primary Examiner* — Anatoly Vortman
*Assistant Examiner* — Jacob Crum
(74) *Attorney, Agent, or Firm* — Sughrue Mion, PLLC

(57) ABSTRACT

An actuator device which includes a fixed support structure, an actuation member movable, a biasing member tending to maintain the actuation member in a rest position, a shape-memory wire connected to the structure and to the actuation member, and an electric circuit for supplying an electric current to the shape-memory wire. The circuit includes a pair of terminals. One end of the shape-memory wire is connected to a first terminal. The circuit includes further an electric switch, including a first conducting member electrically connected with the second terminal, and a second conducting member carried by the actuation member and electrically connected with the other end of the shape-memory wire. The switch is closed when the actuation member is in the rest position, and remains closed until when the actuation member reaches a working position, and opens when the actuation member passes beyond the working position.

10 Claims, 5 Drawing Sheets

(51) Int. Cl.

| | |
|---|---|
| ***H01H 61/01*** | (2006.01) |
| ***A47L 15/44*** | (2006.01) |
| ***H01H 21/86*** | (2006.01) |
| *H01H 37/32* | (2006.01) |

(52) U.S. Cl.
CPC ..... *H01H 21/86* (2013.01); *H01H 61/0107* (2013.01); *H01H 61/066* (2013.01); *H01H 37/323* (2013.01)

(58) Field of Classification Search
CPC ..... H01H 61/0107; H01H 2061/0115–2061/0122; H01H 71/145; H01H 61/066
USPC .... 200/332, 335; 222/52; 337/138–140, 311
See application file for complete search history.

(56) References Cited

U.S. PATENT DOCUMENTS

| | | | | |
|---|---|---|---|---|
| 6,239,686 | B1 * | 5/2001 | Eder | H01H 37/323 337/123 |
| 7,270,135 | B2 | 9/2007 | Virgilio et al. | |
| 7,585,006 | B2 * | 9/2009 | Alacqua | A47L 15/4259 292/244 |
| 7,839,260 | B2 * | 11/2010 | Takahashi | F03G 7/065 324/691 |
| 2008/0271470 | A1 * | 11/2008 | Cheetham | G04C 23/06 62/156 |
| 2009/0173305 | A1 * | 7/2009 | Alexander | F02B 27/001 123/184.53 |

FOREIGN PATENT DOCUMENTS

| | | | |
|---|---|---|---|
| DE | 19 756 679 | A1 | 7/1999 |
| EP | 1 293 596 | A1 | 3/2003 |
| EP | 2 066 218 | A1 | 6/2009 |
| JP | 05-221469 | A1 | 8/1993 |

* cited by examiner

ELECTRICALLY-CONTROLLED ACTUATOR DEVICE, AND WASHING AGENTS DISPENSING DEVICE COMPRISING SUCH AN ACTUATOR DEVICE

BACKGROUND OF THE INVENTION

Field of the Invention

The present invention relates generally to electrically-controlled actuator devices, and in particular to actuator devices for use in electric household appliances.

Background

More specifically, the invention concerns an electrically-controlled actuator device of the kind comprising

- a support structure which is stationary in operation,
- an actuation member displaceable relative to said structure,
- biasing means tending to maintain the actuation member in a rest position,
- a wire of a shape-memory material, having a first end connected to said structure and the other or second end connected to the actuation member, and
- an electric circuit for supplying in a controlled manner an electric current to said shape-memory wire, said circuit comprising a pair of terminals carried by said structure, for connection to external control circuit means, one end of the shape-memory wire being connected to a first terminal of said pair.

An electrically-controlled actuator device comprising a shape-memory wire is disclosed for instance in the U.S. Pat. No. 7,270,135 B2, for use in a washing agents dispensing or distributing device for a dishwashing machine.

In said prior document, with particular reference to FIGS. 1 and 2 thereof, there is disclosed an actuator device comprising a long shape-memory wire which extends along the whole body of the dispensing device, and wherein the displaceable actuation member is a single-arm lever, solid for rotation with a shaft and subjected to the reaction of a biasing spring arranged around said shaft.

Such an actuator device is not suitable for use for instance in a washing agents distributing apparatus of the kind wherein the dispensing in sequence of a first and thereafter a second and different washing agent is controlled by means of subsequent activations of a same actuator device.

An object of the present invention is to propose an actuator device of the above-specified kind, capable of overcoming the above-outlined inconveniences of the devices according to the prior art.

SUMMARY OF THE INVENTION

This and other objects are achieved according to the invention by an actuator device of the above-specified kind, characterized in that the above-mentioned electric circuit comprises a switch including a first conducting member, connected to the second terminal of the above-mentioned pair, and a second conducting member carried by the displaceable actuation member and electrically connected to the other end of the shape-memory wire;

- the arrangement being such that said switch is closed when the actuation member is in its rest position, and remains closed until when the actuation member reaches its working position, said switch opening when the actuation member goes beyond its working position.

BRIEF DESCRIPTION OF THE DRAWINGS

Further features and advantages of the present invention will become apparent from the following detailed description, provided merely by way of a non-limiting example, with reference to the accompanying drawings, wherein.

DETAILED DESCRIPTION OF THE INVENTION

Figure 1:
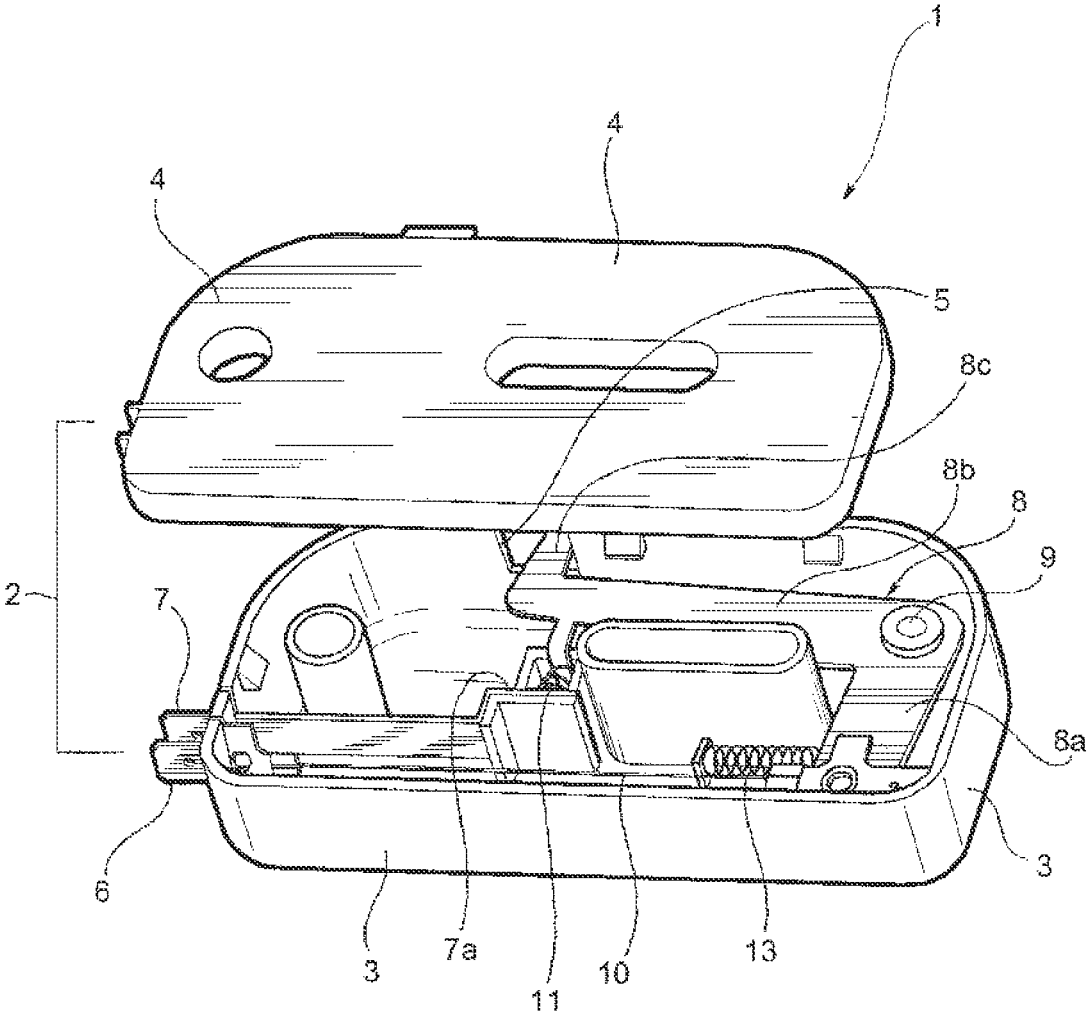
FIG. 1 is a partially exploded perspective view of an electrically-controlled actuator device according to the present invention.

In the drawings by 1 there is indicated as a whole an electrically-controlled actuator device according to the present invention.

In the illustrated exemplary embodiment the actuator device 1 comprises a support casing 2, which is stationary in the operation, and which includes a box-like body 3 and an associated closing cover 4.

Figure 2:
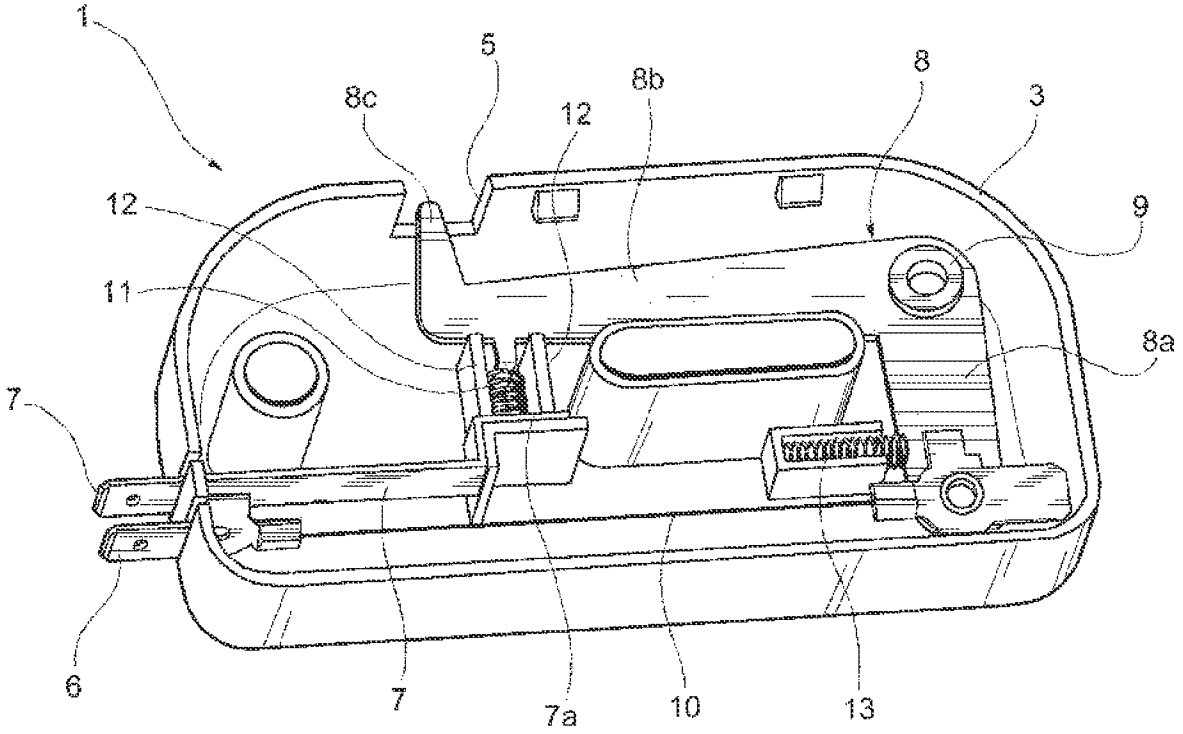
FIG. 2 is a partial perspective view of the actuator device of FIG. 1.

In the embodiment shown, in a lateral wall of the body 3 there is provided a cut-out indicated 5 in FIGS. 1 and 2.

Through another portion of the sidewall of the box-like body 3 two electrical connection terminals 6 and 7, shaped for instance as male plug blades, extend toward the outside.

Inside the box-like body 3 a two-arm lever 8 is mounted pivotable about a fulcrum or axis 9.

The lever 8 has a first arm 8*a* and a second arm 8*b*, which in the illustrated embodiment extend in respective directions forming an angle with one another. That angle in the exemplary embodiment is of about 90°, but could have quite different magnitudes.

The lever 8 is preferably made of a metal material, and the distal end of the arm 8*b* thereof is turned such as to form a transverse appendix 8*c* which extends through the cut-out 5 of the box-like body 3 (see in particular FIG. 2).

Figure 3:
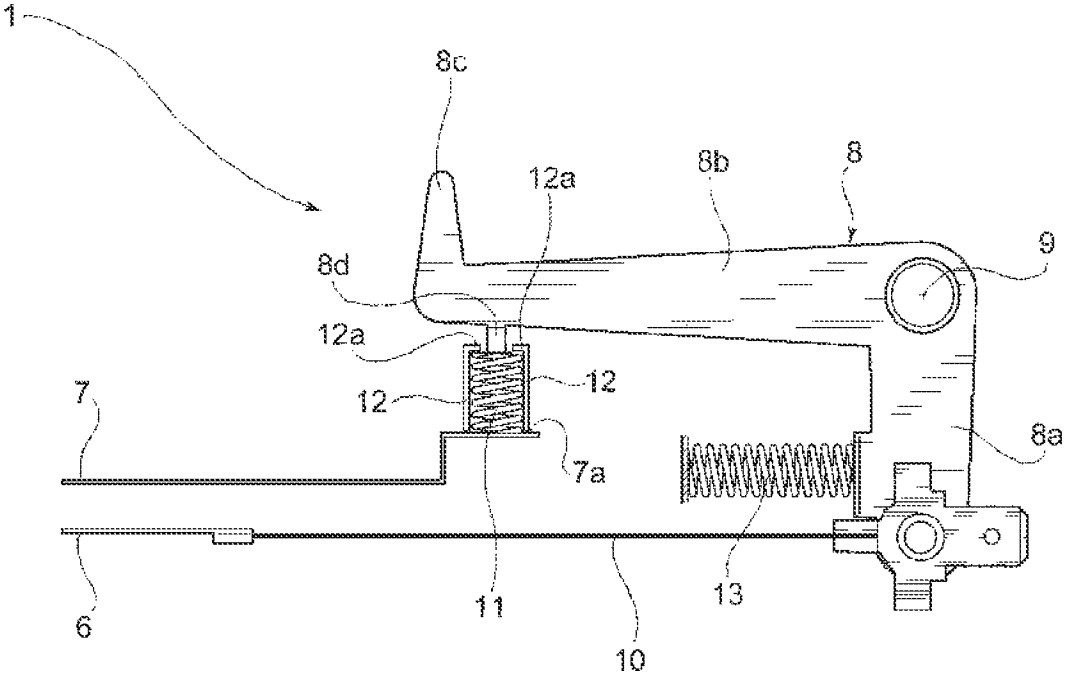
FIG. 3 is a diagrammatical representation of essential parts of the actuator according to the preceding figures.

By 10 in FIGS. 1 to 3 there is indicated a wire made of an electrically conducting or resis-tive shape-memory material.

The wire 10 has one end connected to the electric terminal 6, and the other end anchored to the distal end of the arm 8*a* of the lever 8.

As it can be better seen in FIG. 3, in the illustrated exemplary embodiment, inside the casing 3 the electric terminal 7 extends up to beneath the distal end of the arm 8*b* of the lever 8, and in that area forms a sort of raised shelf 7*a*.

A helical spring 11 of an electrically conducting material rests on the shelf portion 7*a* of the electric terminal 7, and is contained between two opposite parallel walls 12 which are integral with the box-like casing 3 (see in particular FIGS. 2 and 3).

Conveniently, the walls 12 have upper end portions 12*a* which are turned, as it can be seen in FIG. 3, to limit the extension of the spring 11.

An appendix 8*d* of the arm 8*b* of the lever 8 insists onto the upper end of the electro-conducting spring 11. Said appendix 8*d* in the illustrated exemplary embodiment has an essentially L-like shape, with an essentially vertical branch which extends downward from the arm 8*d* of the lever 8, and an essentially horizontal branch which insists onto the elec-tro-conducting spring 11. The terms "vertical" and "horizontal" utilized above are meant for the observer of FIGS. 2 and 3.

By 13 there is indicated a biasing spring which at one end reacts against a shoulder provided in the box-like body 3, and at the other end reacts against the arm 8*a* of the lever 8.

The spring 13 tends to make the lever 8 rotate, in a counter-clockwise direction for the observer of FIGS. 1 to 3, such that the arm 8*b* and the relevant appendix 8*d* insist at rest onto the electro-conducting spring 11, compressing it to a certain extent.

In the rest condition of the actuator device, shown in FIGS. 2 and 3, between the terminal 6 and 7 there is defined an electric path or circuit comprising the shape-memory wire 10, the two-arm lever 8 and the electro-conducting spring 11. In said rest condition the appendix 8*c* of the lever 8 is at least partially retracted inside the casing 3, 4.

If in said rest condition an electric current is made flow in the above-described electric circuit, the shape-memory wire 10 undergoes a contraction, causing a rotation of the two-arm lever 8, in the clockwise direction for the observer of FIGS. 1 to 3, against the reaction of the biasing spring 13. As a consequence of said rotation of the lever 8, the end appendix 8*c* thereof extends to a progressively increasing extent outside the support casing 3, 4 through the cut-out 5. As the rotation of the lever 8 progresses, the electro-conducting spring 11, which was previously compressed, is allowed to relax.

At a certain moment, the appendix 8*d* of the lever 8 leaves the upper end of the electro-conducting spring 11, causing an interruption of the electric circuit between the terminals 6 and 7. This interruption causes the end of the flow of an electric current in the shape-memory wire 10, which starts to re-extend. The re-extension of said wire allows that, under the action of the biasing spring 13, the lever 8 makes a though small rotation in a direction opposite the preceding one, thus in the counter-clockwise direction for whom observes for instance FIG. 3, such that the appendix 8*d* thereof re-engages the upper end of the elec-tro-conducting spring 11. At that time the circuit between the terminals 6 and 7 is once again closed, and an electric current flows again through the shape-memory wire 10 which, by contracting, tends to cause a new rotation of the lever 8 in the clockwise direction for whom is looking at the Figures.

In summary when, starting from the rest condition of the actuator device 1, a voltage is applied between the terminals 6 and 7, the current which consequently flows in the above-described circuit is such as to cause a rotation by a predetermined amount of the two-arm lever 8, which passes from its rest position to a working position. As soon as the lever passes beyond the working position, said electric circuit is interrupted, and the lever 8 tends to rotate in the opposite direction, until when the circuit is closed again, and so on. As a consequence, until when a voltage is still applied between the terminals 6 and 7, the lever 8 substantially remains in its working position or, to be more precise, undergoes an almost non-perceptible oscillation thereabout.

When the application of the voltage between the terminals 6 and 7 is stopped, then also the flow of an electric current in the above-mentioned circuit, and in particular in the shape-memory wire 10, ceases. Under the action of the biasing spring 13, the lever 8 abandons its working position, to regain its rest position, wherein it definitely remains until a subsequent application of voltage between the terminals 6 and 7.

In view of the above, in the operation the behaviour of the actuator device 1 is functionally similar to that of a conventional solenoid actuator, with respect to which it has however a much simpler structure, a lower cost and a more reliable operation.

The operational characteristic of an actuator according to the present invention is absolute-ly repeatable, for a very high number of activations or cycles of operation.

Figure 4:
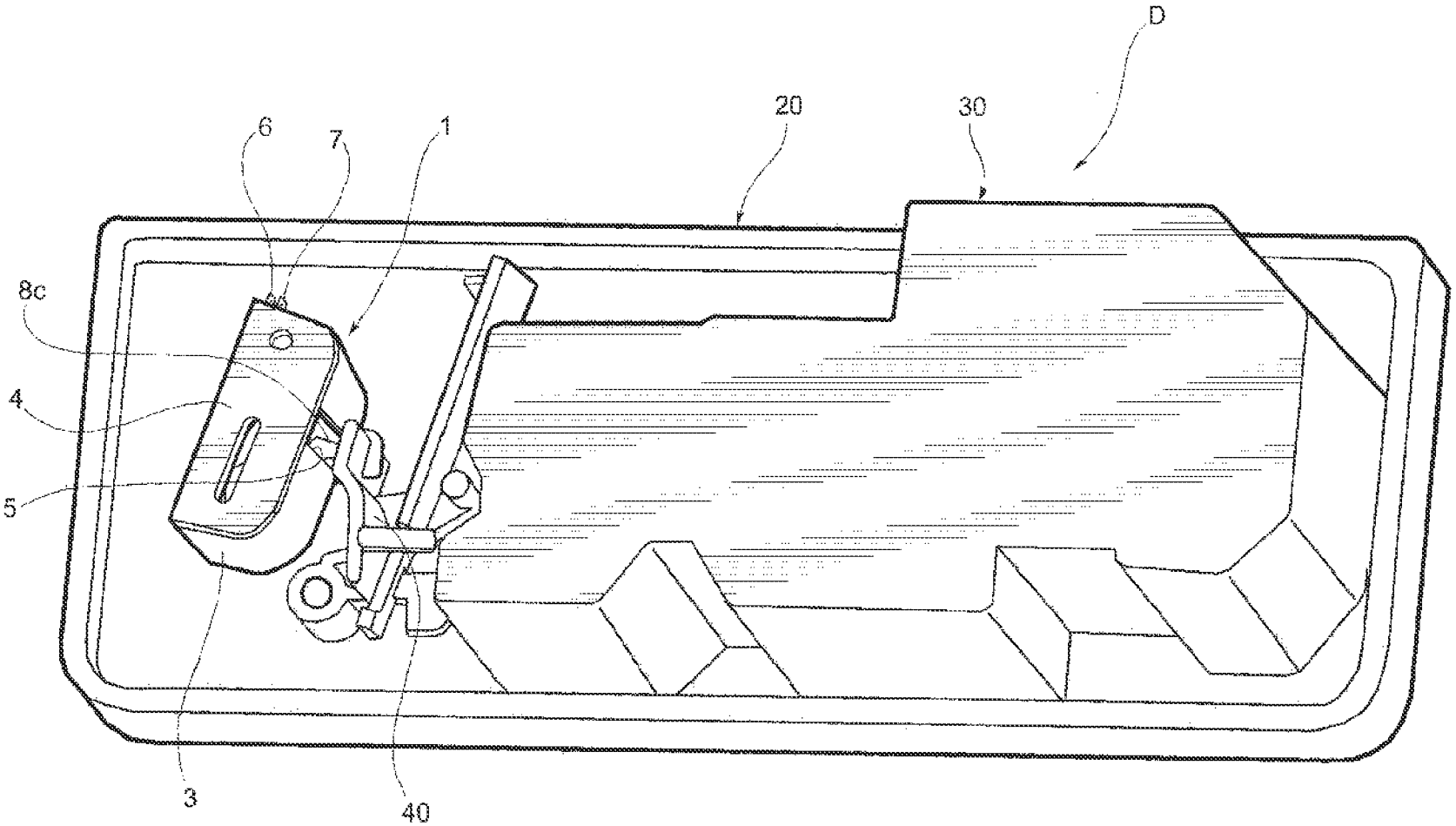
FIG. 4 is a rear perspective view of a washing agents dispensing apparatus, particularly for a dishwashing machine, comprising an electrically-controlled actuator device according to the preceding figures.

In FIG. 4 by D is indicated as a whole a washing agents dispensing apparatus, of a per se known kind, particularly for a dishwashing machine.

Said dispensing device D essentially comprises two dispensing sections, indicated 20 and 30, for dispensing a washing agent like a powder detergent, and a liquid rinsing agent, re-spectfully.

Dispensing devices of that kind are disclosed for instance in patent applications DE 19 756 679 and DE 19 545 773.

The dispensing device D is of the (per se known) kind wherein the two dispensing sections 20 and 30 can be selectively activated in sequence, through subsequent activations of a same control member 40, activations which are conveniently caused by means of an electrically operable actuator device 1 of the kind described above, incorporated in the dispensing device D.

In the application illustrated in FIG. 4 the actuator device 1 according to the invention conveniently replaces a conventional electric solenoid actuator.

Figure 5:
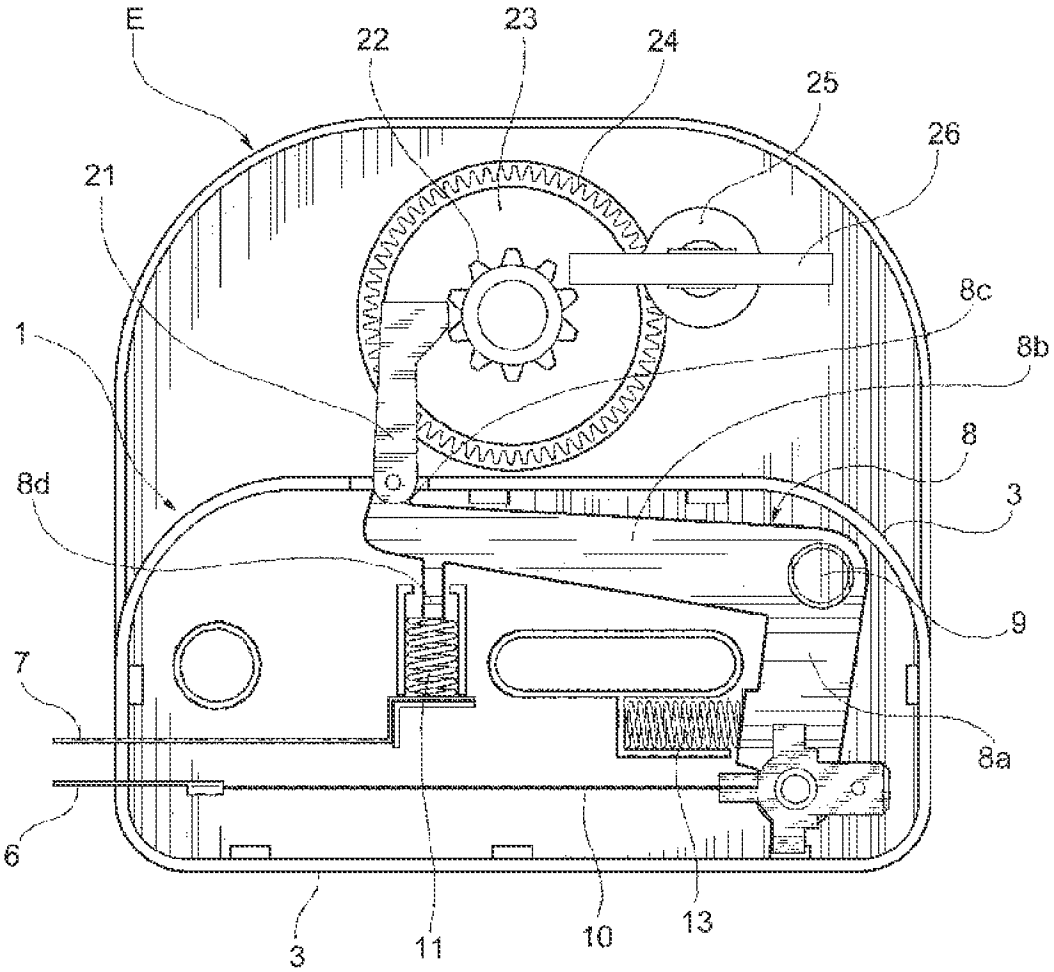
FIG. 5 is a view of a further apparatus including an electrically-controlled actuator device according to the present invention.

In FIG. 5 there is illustrated a further apparatus E which includes an actuator device 1 according to the present invention.

In that embodiment the end 8*c* of the two-arm lever 8 of the actuator device 1 is coupled with a pawl 21, which cooperates with the teeth 22 of a gear wheel 23.

Subsequent applications of voltage between terminals 6 and 7 of the actuator device 1 cause corresponding finite or step-like angular displacements of gear wheel 23, as a consequence of the engagement of the pawl 21 with the teeth 22.

A step-wise rotation of the gear wheel 23 can be utilized for a number of purposes. In the exemplary illustrated embodiment said gear wheel also has a crown of teeth 24 with a larg-er diameter, meshing with a toothed pinion 25 which is solid with a wall 26. The diameters of the toothed crowns 22 and 24 and the diameter of the pinion 25 can be selected such that at each rotation step of the gear wheel 23, caused by the actuator device 1, a rotation of the wall 26 by 90° is caused. The wall 26 can for instance be the obturator of a conduit, which can be thus selectively switched from a condition of opening to a condition of closure, and thereafter a condition of opening, and so on.

The application described above with reference to FIG. 5 is merely exemplary, the actuator device 1 according to the present invention being capable of finding a great number of useful technical applications.

Naturally, the principle of the invention remaining the same, the embodiments and the de-tails of construction may be widely varied with respect to what has been described and illustrated by way of non-limiting examples, without departing from the scope of the invention as defined in the annexed claims.

The invention claimed is:

1. An actuator device, comprising a support structure which is stationary in the operation, an actuation member, displaceable relative to said structure, biasing means tending to maintain the actuation member in a rest position, a wire made of a shape-memory material, having a first end connected to said structure, and the other end connected to the actuation member, and an electric circuit for supplying in a controlled manner an electric current to said shape-memory wire, said circuit comprising a pair of terminals carried by said structure, for connection to an external control circuit, one end of the shape-memory wire being connected with a first terminal of said pair;

wherein said electric circuit comprises an electric switch including a first conducting member electrically connected to the second terminal of said pair, and a second conducting member carried by the actuation member and electrically connected to the other end of the shape-memory wire;

the arrangement being such that said switch is closed when the actuation member is in the rest position, and remains closed until when the actuation member reaches a working position, said switch opening when the actuation member passes beyond the working position.

2. The actuator device according to claim 1, wherein the actuation member is at least in part made of an electrically-conducting material, and electrically connects said second member of the switch with said shape-memory wire.

3. The actuator device according to claim 1, wherein said first conducting member of the switch has the shape of an helical spring made of an electrically conducting material, connected at one end with said second terminal, and cooperating at the other end with said second conducting member carried by the actuation member.

4. The actuator device according to claim 1, wherein the actuation member comprises a lever pivotable about an axis in said structure and having a first arm with which the shape-memory wire is connected, and a second arm having an actuating formation.

5. The actuator device according to claim 4, wherein said actuating formation is an appendix which extends transversely from said second arm of the lever and capable, when the lever is in the working position, of protruding to a predetermined extent outside said support structure.

6. The actuator device according to claim 4, wherein said first arm of the lever forms an angle with respect to the second arm of said lever.

7. The actuator device according to claim 4, wherein said second arm of the lever extends along said shape-memory wire.

8. The actuator device according to claim 1, wherein the biasing means comprises a biasing spring, interposed between said support structure and the actuation member.

9. The actuator device according to claim 4, wherein said biasing means is interposed between said support structure and the first arm of the lever.

10. A dispensing apparatus for a dishwashing machine, comprising first and second dispensing means selectively activatable in sequence for dispensing a quantity of a first and thereafter a second washing agent, as a consequence of subsequent activations of a same control member with which there is associated the actuator device according to claim 1.

* * * * *